US007987981B1

(12) United States Patent
Lee

(10) Patent No.: US 7,987,981 B1
(45) Date of Patent: Aug. 2, 2011

(54) WRENCH HOLDER

(76) Inventor: Hong-Jen Lee, Taichung (TW)

( * ) Notice: Subject to any disclaimer, the term of this patent is extended or adjusted under 35 U.S.C. 154(b) by 0 days.

(21) Appl. No.: 12/982,921

(22) Filed: Dec. 31, 2010

(51) Int. Cl.
*B65D 85/28* (2006.01)

(52) U.S. Cl. ..... 206/376; 206/45.24; 206/372

(58) Field of Classification Search ..... 206/45.24, 206/349, 372–379, 477, 482; 211/70.6
See application file for complete search history.

(56) References Cited

U.S. PATENT DOCUMENTS 5,346,063 A * 9/1994 Chow ..... 206/376
6,202,864 B1 * 3/2001 Ernst et al. ..... 206/376
6,679,391 B1 * 1/2004 Huang ..... 206/376
6,758,350 B2 * 7/2004 Lin ..... 206/376
6,832,684 B2 * 12/2004 Huang ..... 206/376
6,976,582 B2 * 12/2005 Chen ..... 206/376
7,055,689 B2 * 6/2006 Chen ..... 206/376
7,559,427 B2 * 7/2009 Hu ..... 206/45.24
7,815,058 B2 * 10/2010 Cheng ..... 206/376

* cited by examiner

*Primary Examiner* — Luan K Bui

(57) ABSTRACT

The present invention discloses a wrench holder which includes main body, handle, control element, connecting elements and door boards. The front of the main body is provided with a plurality of recesses for engaging wrench handles, and provided with fillister having wall provided with hookable part thereon. The handle is pivotally connected to the bottom of the main body. The handle can be bent to support the main body on a plane. The control element is pivotally disposed in the fillister. The connecting elements are pivotally connected to the main body and the door boards respectively. The door boards cover the main body and have bar part. The end of the bar part has a hooking edge to hook the hookable part in the fillister. When the control element is pulled to rotate and push away the hooking edge. Thus, users can open the door boards.

11 Claims, 8 Drawing Sheets

WRENCH HOLDER

FIELD OF THE INVENTION

The present invention relates to a wrench holder, especially to a wrench holder whose main body is pivotally connected to two door boards and one handle, and in which a plurality of wrenches can be inserted. Such wrench holder is easy to be carried away, easy for placing and removing wrenches, and also enhances aesthetic beauty.

BACKGROUND OF THE INVENTION

According to the prior art of a wrench holder disclosed in U.S. Pat. No. 5,346,063, it comprises a flat main frame which has two pieces of plates protruded from its both sides on the front. There is a plurality of recesses symmetrically defined on the two plates for wrenches to be placed. Each opening of the recess has a hook, and the wrenches are prevented falling from the recesses by the hooks. There are certain disadvantages from the prior art:

1. Wrenches are not able to be firmly held in the recesses with only two plates and simple-designed recesses on the main frame.

2. The holder can only be laid down due to the flat design of the main frame. Because the wrench holder is not standable, it causes inconvenient for users to choose proper wrenches.

SUMMARY OF THE INVENTION

The purpose of the present invention is to provide a wrench holder which is easy to store wrenches in, carried wrenches with, place and remove wrenches from, and enhances aesthetic beauty. The technical means to achieve this object includes one main body, one handle, at least one control element, two connecting elements and two door boards. The front of the main body is provided with a plurality of recesses which wrench handles can be inserted in. The main body has fillisters. The wall of the fillister is provided with a hookable part. The handle is pivotally connected to the bottom of the main body. When the handle is bent an angle relatively toward the main body, the handle can support the main body to erect on one plane. The control element has two wing-shaped pieces pivotally disposed in the fillisters of the main body. The two connecting elements are pivotally connected to the main body and the door boards respectively. The two door boards symmetrically cover the front of the main body. Each door board has one bar part. There is a hooking edge at the end of the bar part to hook the hookable part in the fillister. When one wing-shaped piece is pulled, the control element will be rotated together to push away the hooking edge. Thus, users can open the door boards.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
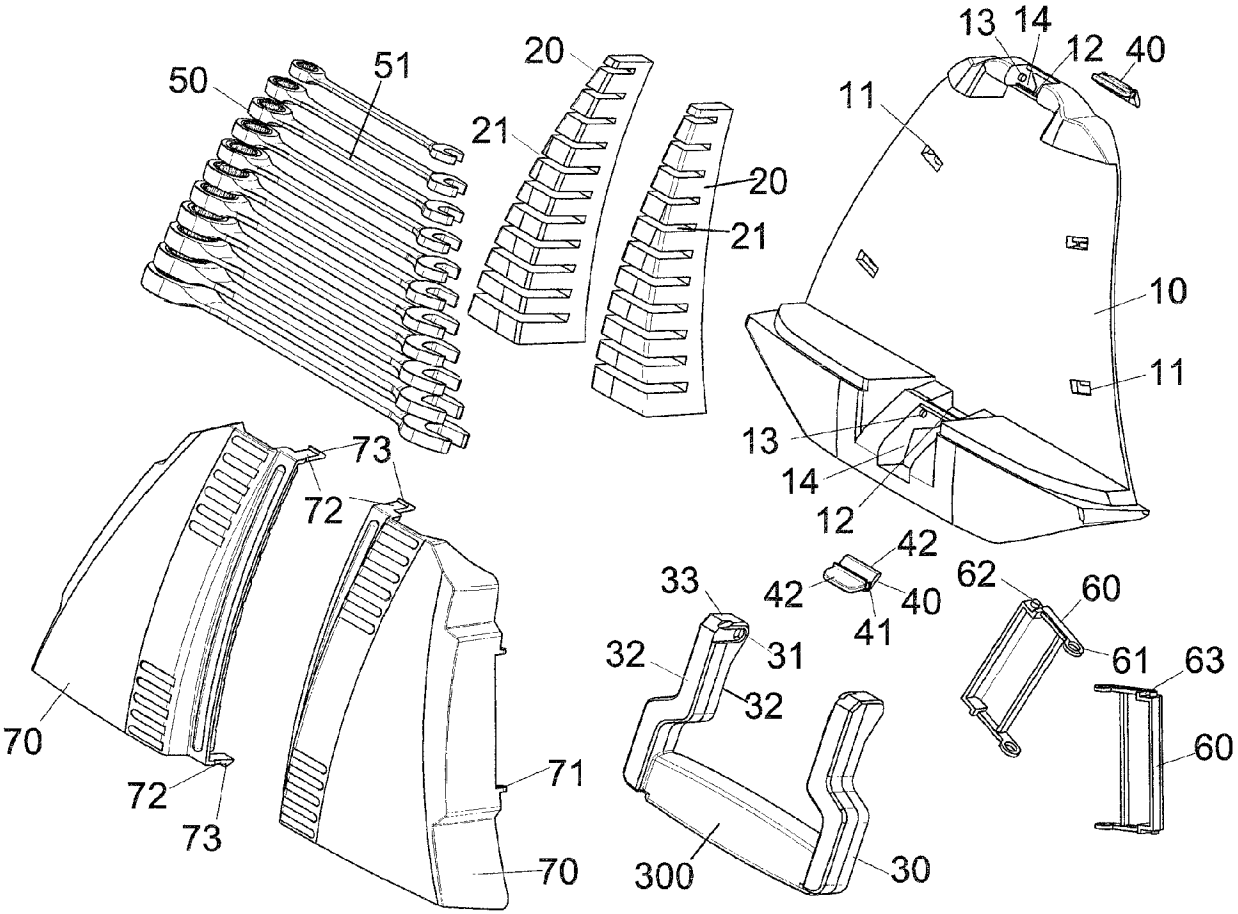
FIG. 1 is a 3D exploded view of the front of the wrench holder of the invention.

Referring to FIGS. 1 to 4, the wrench holder of the present invention includes one main body 10, a plurality of recesses 21, one handle 30, at least one control element 40, two connecting elements 60 and two door boards 70. Each of the above-mentioned components is described below.

Figure 2:
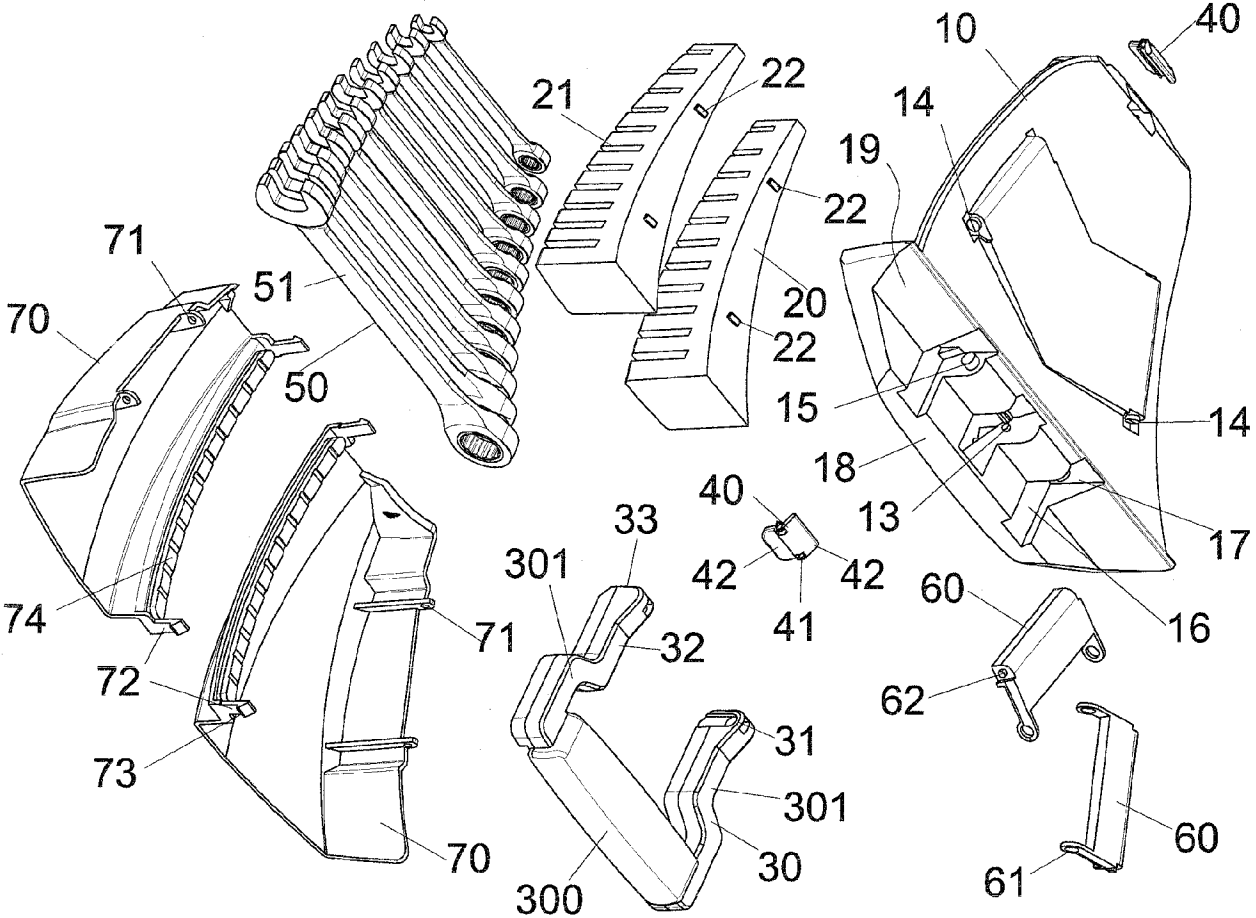
FIG. 2 is a 3D exploded view of the back of the wrench holder of the invention.

As FIGS. 1 and 2 shown, a plurality of recesses 21 is distributed on front of the main body 10. The plurality of recesses 21 is vertically arranged at least in one row. The figure illustrates two vertical rows.

Each recess 21 horizontally goes through, and can be inserted with one handle 51 of the wrench 50. The figure illustrates two vertical rows of recesses 21. Every two recesses 21 on the same level form one pair. Each pair of recesses 21 are inserted with one handle 51 of the wrench 50.

The top or the bottom of the main body 10 is provided with at least one fillister 14. The figure illustrates that the top and the bottom are provided with one fillister 14 respectively. The wall of each recess 14 has one hookable part respectively. The figure illustrates the hookable part as a beam. The figure illustrates that a plurality of recesses 21 is on two lumps 20 respectively. The lumps 20 and the main body 10 can integrate into one unit. The figure illustrates that the front of the main body 10 has sunken holes 11. The bodies have raised edges 22 which are inserted into the sunken holes 11. Thus, the lumps 20 are fixed to the front of the main body 10.

Figure 8:
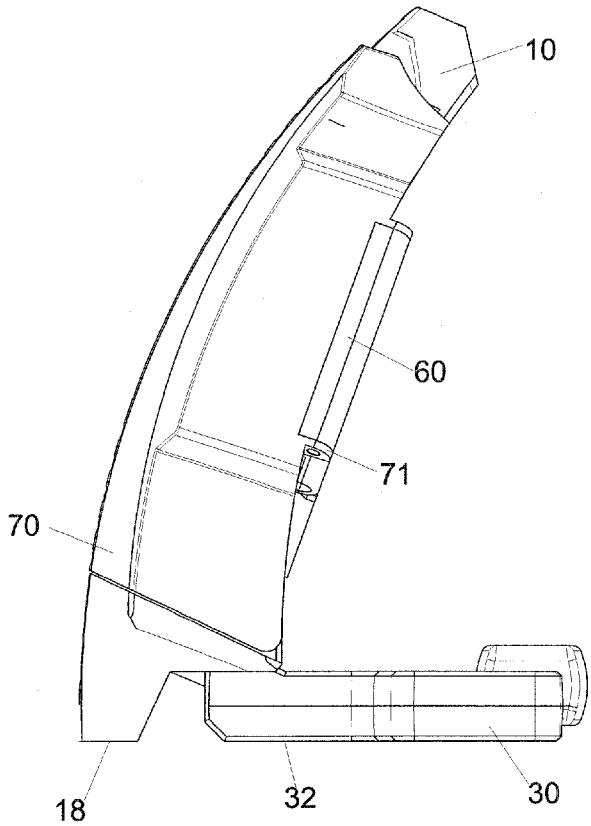
FIG. 8 is a 3D side view of the erected wrench holder of the invention.
Figure 9:
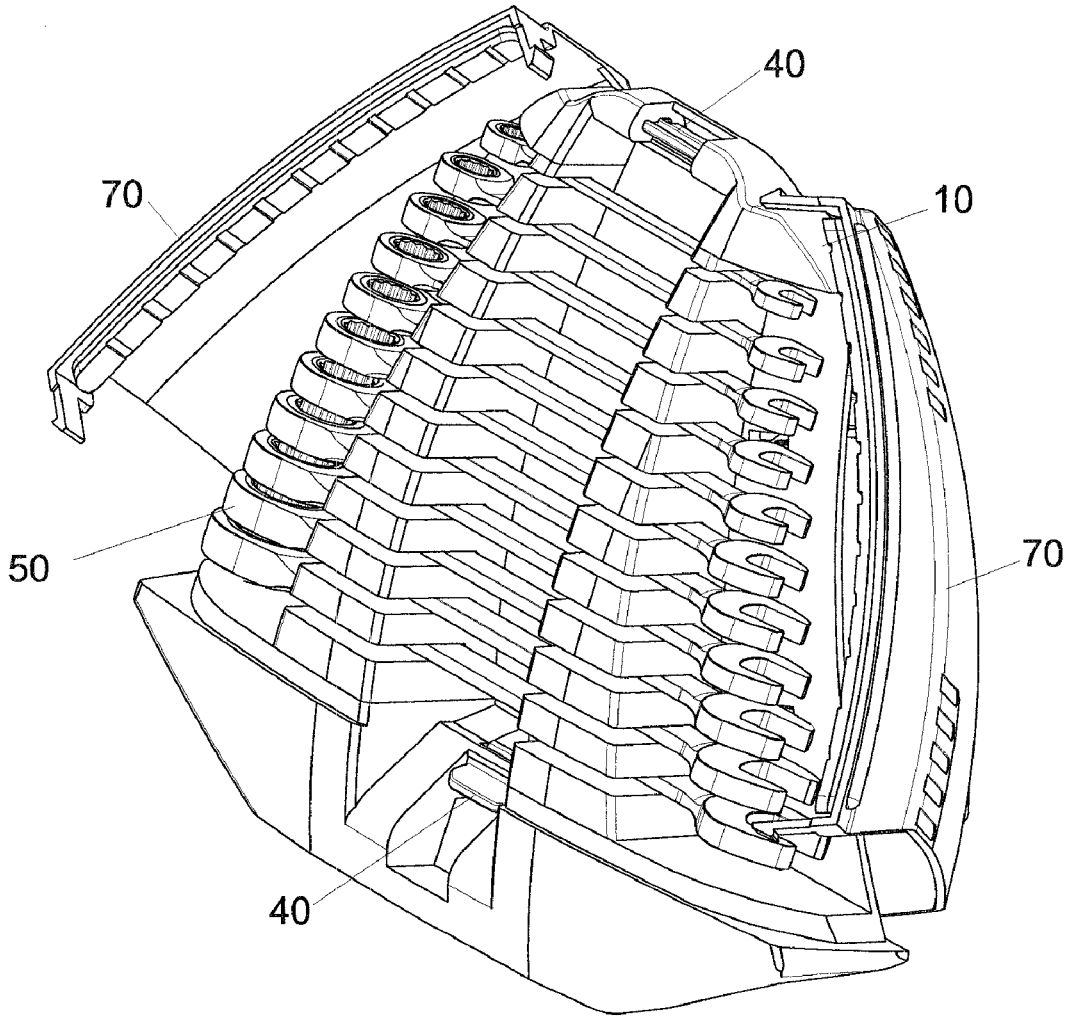
FIG. 9 is a 3D front view when the wrench holder of the invention is opened.
Figure 10:
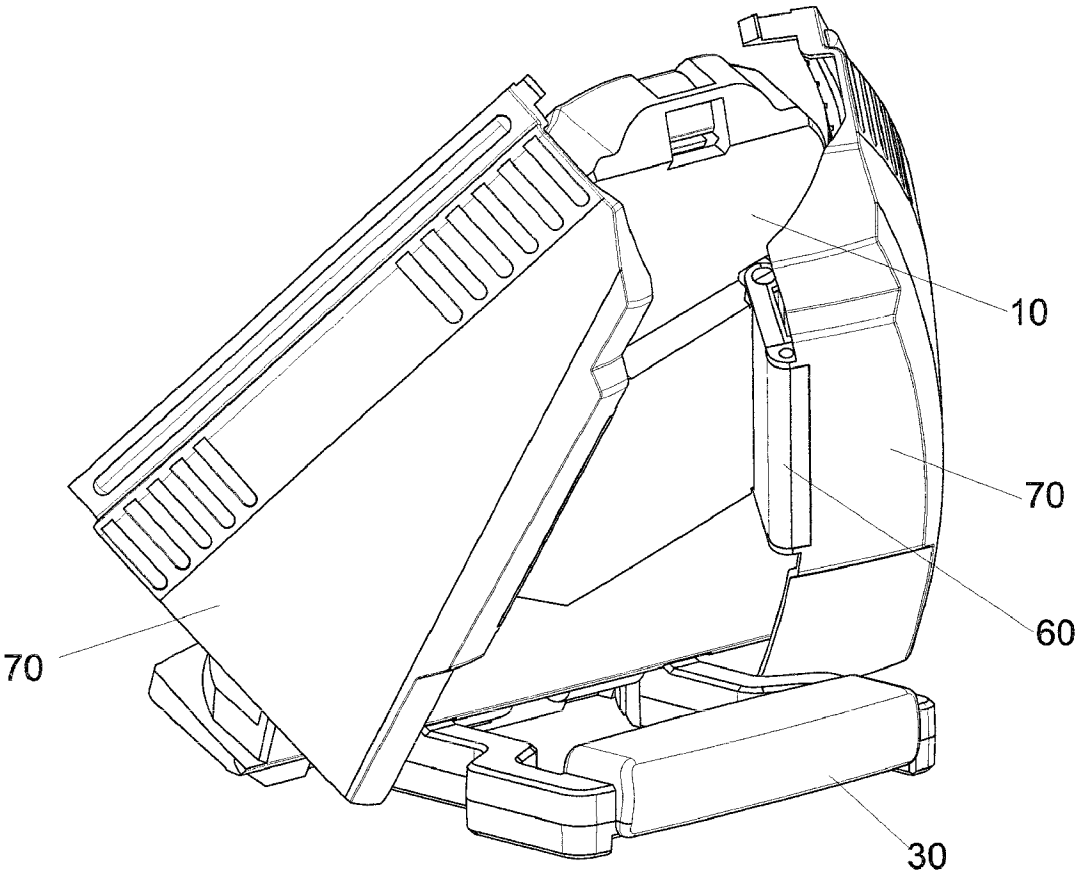
FIG. 10 is a 3D back view when the wrench holder of the invention is opened.

Referring to FIGS. 1 and 2, the handle 30 includes one grip part 300. The grip part 300 has two bar elements 301 protruding from one side of the grip 300. The two bar element 301 pivotally connect the bottom of the main body 10 respectively. Referring to FIG. 8 through FIG. 10, when the handle 30 is bent an angle relatively toward the main body 10, the handle 30 horizontally extends toward the back of the main body 10 so as to support the main body 10 to erect on a plane.

As FIGS. 1 and 2 shown, there are two control elements 40. Every control element 40 comprises two wing-shaped pieces 42 whose included angle is less than 180 degrees. The control element 40 is pivotally installed in the fillister 14 of the main body 10. The figure illustrates that two control elements 40 are pivotally installed in two fillister 14 respectively.

As FIGS. 1 and 2 shown, two connecting elements 60 have one first end and one second end, being reverse of each other respectively. The first end has one pivotal part 61 pivotally installed in the middle section of the back of the main body 10. The figure illustrates that the second end of the connecting element 60 has one raised part 63 which limits the door board 70 to make a maximum rotating angle relatively toward the connecting element 60 and the main body 10

Figure 3:
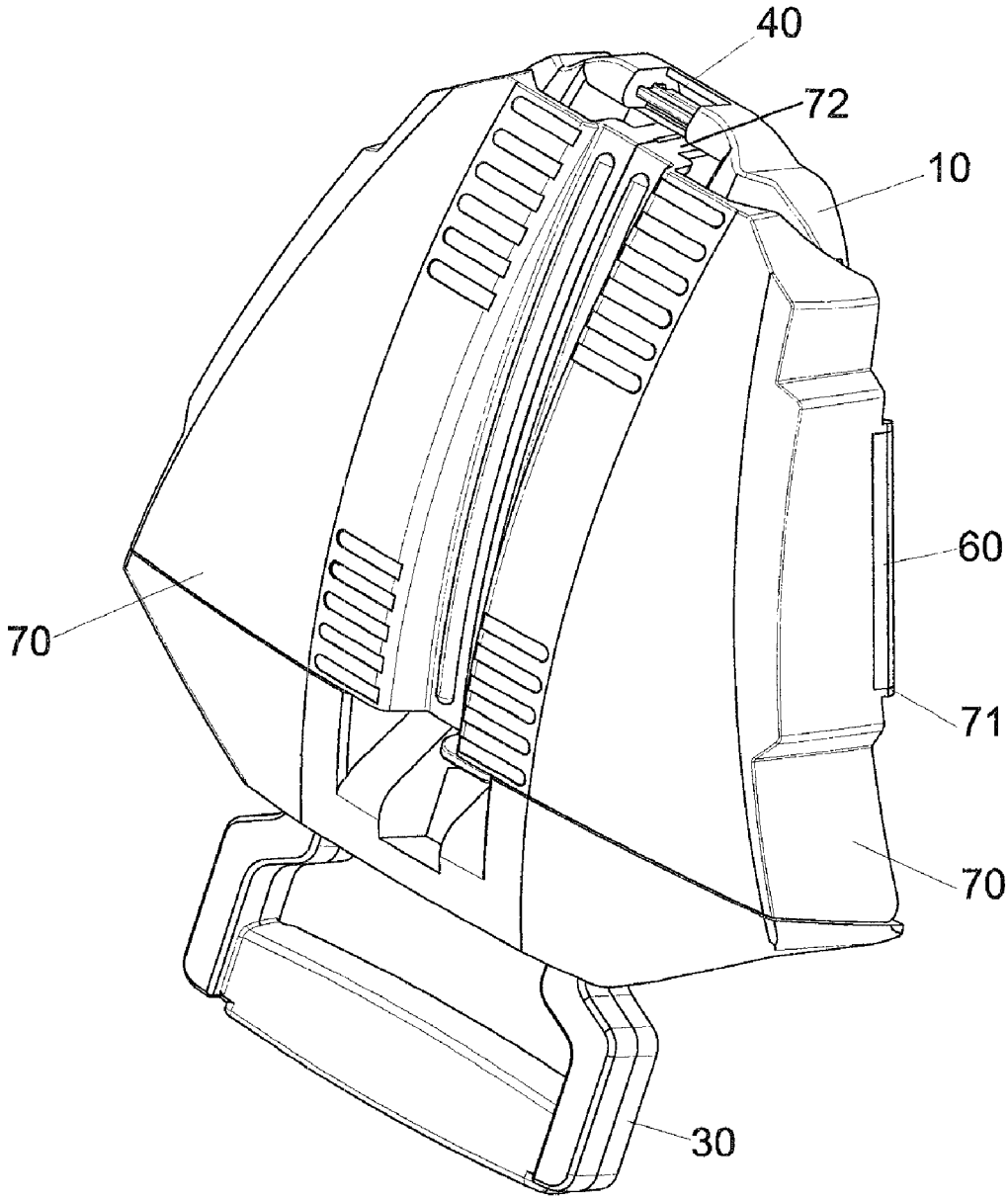
FIG. 3 is a 3D assembly view of the front of the wrench holder of the invention.
Figure 4:
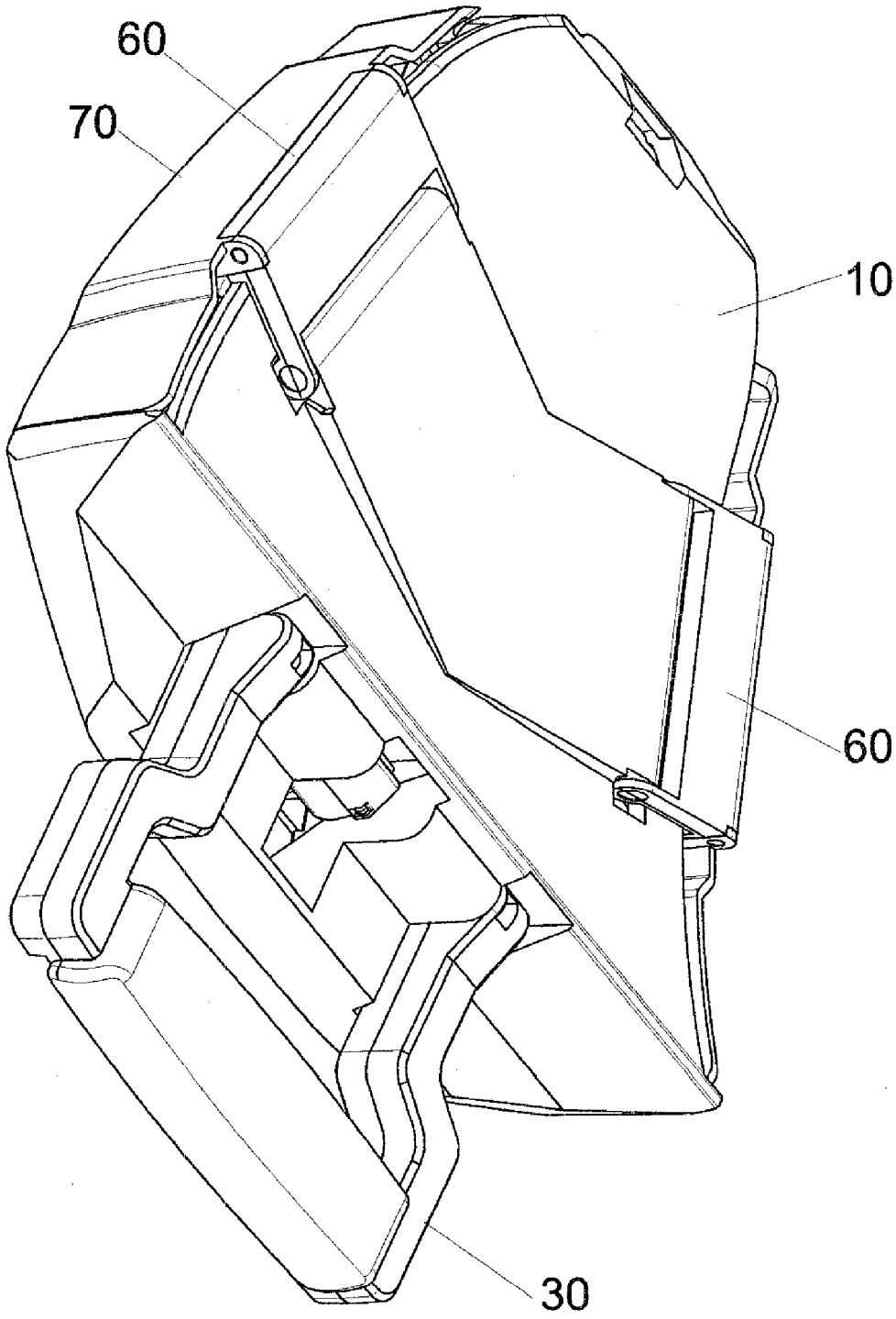
FIG. 4 is a 3D assembly view of the back of the wrench holder of the invention.

Referring to FIG. 1 through FIG. 3, the two door boards 70 symmetrically cover the front of the main body 10 so as to seal the wrench 50. Every door board 70 has one first end and one second end, being reverse of each other. The edge of the first end pivotally connects the second end of the connecting element 60. The figure illustrates that the edge of the first end has a raised pivot part 71 which pivotally connects the connecting element 60.

Figure 7:
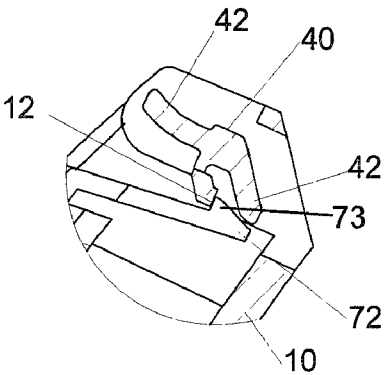
FIG. 7 is an enlarged view taken along circle B in FIG. 6.
Figure 6:
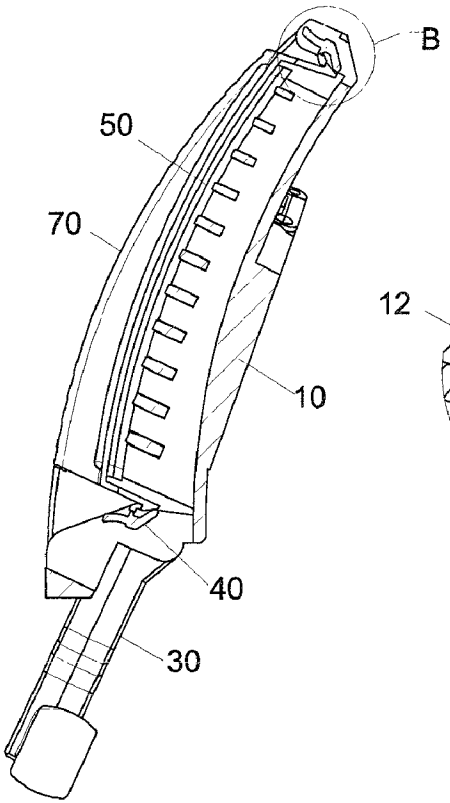
FIG. 6 is a cross-sectional view taken along plane A-A in FIG. 5.

The top or the bottom of the edge of the second end has a bar part 72 protruding out from one side. The figure illustrates that both the top and the bottom of the edge of the second end are provided with one bar part 72. Referring to FIGS. 6 and 7, the distal end of the bar part 72 has one hook edge 73 to hook the hookable part in the fillister 14 on the main body 10, and contacts one wing-shaped piece 42 of the control element 40. When another wing-shaped piece 42 of the control element 40 is pushed, the control element 40 will be moved together to push away the hook edge 73. Then, users can open the door boards 70.

Referring to FIGS. 1 through 3, there is a preferred embodiment of the invention. The wall of the fillister 14 is provided with one raised first pivot 13. The center of the end face of the control element 40 is provided with the first pivot hole 41 which the first pivot 13 can be inserted in so that the control element 40 can be pivotally installed in the fillister 14.

Referring to FIG. 1 through FIG. 3, one preferred embodiment of the invention is that the bottom of the main body 10 has one connecting bottom face 19 and one extending-down face 18. The bottom face 19 and the extending-down face 18 have at least one horizontal recess 17 and at least one vertical recess 16 respectively. The figure illustrates two horizontal recesses 17 and two vertical recesses 16. The horizontal recess 17 is connecting with the corresponding vertical recess 16. The wall of every horizontal recess 17 has one raised second pivot 15. The recess 14 at the bottom of the main body 10 is between the two horizontal recesses 17 and two horizontal recesses 16. Furthermore, the figure illustrates that the area near the end of every bar element 301 has one second pivotal hole 31 which the second pivot 15 is inserted into.

Figure 5:
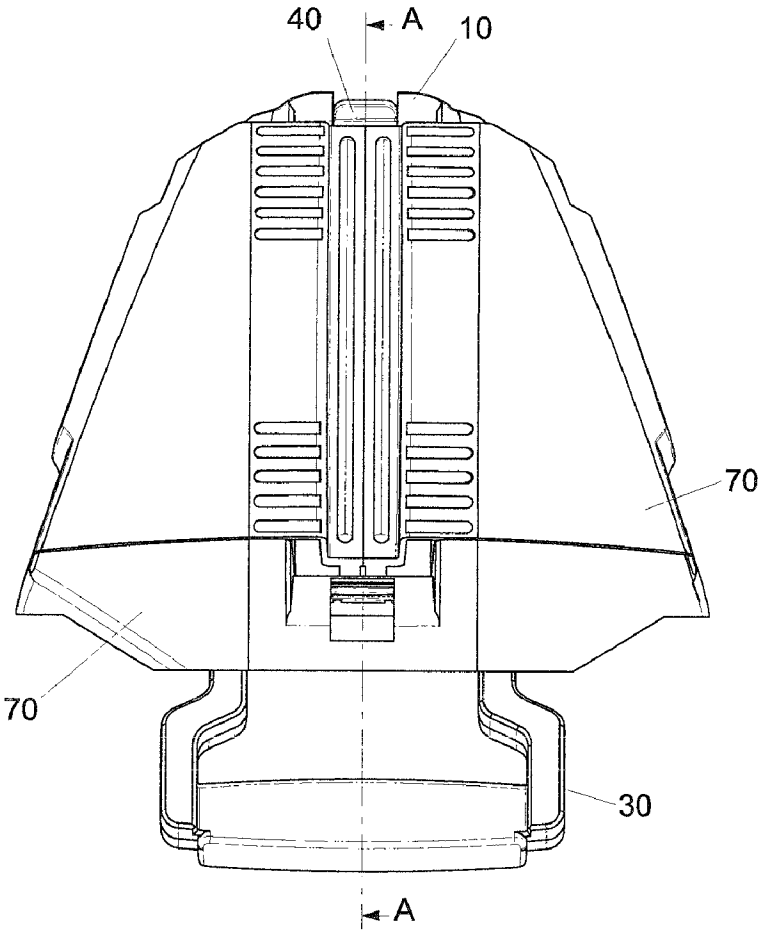
FIG. 5 is a front view of the wrench holder of the invention.

The bar element 301 has two lateral sides 32, being reverse of each other. Referring FIG. 4 through FIG. 6, when the handle 30 extends vertically down relatively toward the main body 10, one lateral side 32 of the handle pushes the vertical recess 16. When the handle 30 is bent relatively toward the main body 10, and horizontally extends, another lateral side 32 pushes the horizontal recess 17.

Referring to FIG. 1 through FIG. 3, a preferred embodiment of the invention is that the middle section of the edge of the second section of every door board 70 has a vertical press strip 74 to press the handle 51 of the wrench 50. The figure illustrates that the press strip 74 is one single part firmly sticking to the door board 70. Furthermore, the press strip 74 is made of soft material to avoid damaging the surface of the wrench 50.

The advantages of the present invention are shown below:

1. After the wrench 50 is inserted into the recess 21, the wrench 50 will be covered by the two door boards 70, and stably stored in the main body 10.

2. The two door boards 70 combine and cover the main body 10 so that the wrenches 50 can be stored inside, and avoid being soiled, and also improve the aesthetic beauty for a whole wrench holder.

3. The handle 30 extends down relatively toward the main body 10. It is very portable. If the handle 30 is bent relatively toward the main body, the handle 30 can support the main body 10 to erect on a plane, and press the control element 40 further. Thus, the door boards can be opened to facilitate the access of the wrenches 50 on the main body 10.

While we have shown and described the embodiment in accordance with the present invention, it should be clear to those skilled in the art that further embodiments may be made without departing from the scope of the present invention.

What is claimed is:

1. A wrench holder comprising:

a main body whose front has a plurality of vertically-arranged horizontal recesses, each recess being inserted with a handle of a wrench; the main body having at least one fillister, the wall of the fillister being provided with one hookable part;

a handle comprising a grip part and at least one bar part protruding from one side of the grip part, the bar part being pivotally connected to the bottom of the main body; when the handle being bent an angle relatively toward the main body, the handle directing the back of the main body horizontally and extending to support the main body to erect on a plane; and at least one control element comprising two wing-shaped pieces with an included angle, the control element being pivotally installed in the groove of the main body; two connecting elements each having opposite a first end and a second end, the first end of each connecting element being pivotally installed at the middle section of the back of the main body; and two door boards symmetrically covering the front of the main body so as to seal the wrench, each door board having opposite a first end-edge and a second end-edge, the first end-edge of each door board being pivotally connected to the second end of the connecting element respectively, the second end-edge having at least one bar part protruding from one side of the end-edge, the distal end of the bar part having a hookable edge to hook the hookable part in the fillister and touch one wing-shaped piece of the control element; when another wing-shaped piece of the control element being pushed, then the control element being rotated to push away the hookable edge, and the door boards being able to be opened.

2. The wrench holder as claimed in claim 1, wherein the plurality recesses is installed on two lumps respectively, the front of the main body is provided with a sunken hole, the lump has one raise edge being inserted into the sunken hole so that the lump is fixed to the front of the main body.

3. The wrench holder as claimed in claim 1, wherein the wall of the groove has one raised first pivot, and the center of end face of the control element is provided with one first pivotal hole which the first pivot is inserted into.

4. The wrench holder as claimed in claim 1, wherein the top and the bottom of the main body are provided with one fillister respectively, each fillister has one hookable part and one pivotally installed control element; the top and the bottom of the second end-edge of the door board are provided with one bar part respectively.

5. The wrench holder as claimed in claim 1, wherein the bottom of the main body is provided with a mutually connected bottom face and one extending-down face, the bottom face and the extending-down face are provided with two horizontal recesses and two vertical recesses respectively, one corresponding horizontal recess is connecting with one vertical recess, the wall of each horizontal recess is provided with one raised second pivot; the recess at the bottom of the main body is positioned between the two horizontal recesses and the two horizontal recesses; the handle has two bar parts, the area near the end of each bar part is provided with one second pivotal hole which the second pivot is inserted into.

6. The wrench holder as claimed in claim 5, wherein the bar part has two lateral sides reverse of each other; when the handle extends vertically down relatively toward the main body, one of its lateral sides pushes the vertical recess; when the handle is bent relatively toward the main body, and horizontally extends, another lateral side pushes the horizontal recess.

7. The wrench holder as claimed in claim 1, wherein the middle section of the second end-edge is provided with a vertically extending press strip to press the handle of the wrench.

8. The wrench holder as claimed in 7, wherein the press strip is a single part fixing to the door boards.

9. The wrench holder as claimed in claim 8, wherein the press strip is made of a soft material.

10. The wrench holder as claimed in claim 1, wherein the hookable part is a beam.

11. The wrench holder as claimed in claim 1, wherein the connecting element is provided with a raised part to limit the door board to make a maximum rotating angle relatively toward the connecting element and the main body.

* * * * *